United States Patent [19]

Stranges

[11] Patent Number: 4,872,550

[45] Date of Patent: Oct. 10, 1989

[54] DUAL PURPOSE CARRYING CONTAINER

[76] Inventor: Frank Stranges, 7296 Woodgate St., Niagara Falls, Ontario, Canada, L2J 3Z5

[21] Appl. No.: 160,957

[22] Filed: Feb. 26, 1988

[51] Int. Cl.[4] ..... B65D 85/20; A63F 3/00

[52] U.S. Cl. ..... 206/315.1; 273/285

[58] Field of Search ..... 273/285, 260, 148 A; 206/315.1, 579; 220/23.86, 20.00

[56] References Cited

U.S. PATENT DOCUMENTS

| | | | |
|---|---|---|---|
| 166,776 | 8/1875 | Herzog | 273/148 A |
| 414,490 | 11/1889 | Bretzfield | 273/148 A |
| 1,659,588 | 2/1928 | Balmforth | 273/148 A |
| 2,454,691 | 11/1948 | Ellingson | 273/149 |
| 2,544,900 | 3/1951 | Saqui | 273/148 A |
| 2,600,951 | 6/1952 | Edwards | 273/148 A |
| 2,784,973 | 2/1956 | Nemec | 273/148 A |
| 2,913,137 | 11/1959 | Alatorre | 220/20 |
| 3,851,885 | 12/1974 | Pepkowski | 273/287 |
| 4,261,576 | 4/1981 | Friedenthal | 273/285 |
| 4,337,861 | 7/1982 | Smart | 206/579 |
| 4,521,021 | 6/1985 | Dixon | 273/148 B |
| 4,579,224 | 4/1986 | Heavener | 206/315.1 |

FOREIGN PATENT DOCUMENTS

| | | | |
|---|---|---|---|
| 1143908 | 10/1957 | France | 273/285 |
| 2587906 | 4/1987 | France | 273/260 |
| 1163871 | 6/1985 | U.S.S.R. | 273/260 |

*Primary Examiner*—Edward M. Coven
*Assistant Examiner*—Benjamin Layno
*Attorney, Agent, or Firm*—Rogers, Bereskin & Parr

[57] ABSTRACT

A dual purpose carrying container and playing board, display surface or tool holder. The carrying container has two upper sections hingedly connected together like a suitcase but has a detachable base. The upper sections hinge relative to each other from a closed to an open position. The base attaches to the two upper sections when they are in the closed position to define an interior volume. The base is detached from the two upper sections in the open position. In the open position, the upper sections create an enclosed playing surface for playing board games, displaying items, or holding tools.

3 Claims, 3 Drawing Sheets

DUAL PURPOSE CARRYING CONTAINER

FIELD OF THE INVENTION

This invention relates to carrying containers and has particular application to carrying containers for board games.

BACKGROUND OF THE INVENTION

This invention was developed to meet a need for a carrying container that could function as both a carrying device and as a playing surface for a board game. The invention has particular application to those board games in which a single planar surface with surrounding walls is desirable, such as a game in which dice are thrown.

However, generally the invention also has application to a number of uses where it is desirable for a carrying container to have a second function such as, a playing surface, in the case of a board game; a display surface, in the case of a jewellery container; or a tool mounting surface, in the case of a tool box.

SUMMARY OF THE INVENTION

Accordingly, this invention provides a dual purpose carrying container comprising a first section having a first substantially planar surface and a wall surrounding the first substantially planar surface on all but one open side; a second section having a second substantially planar surface, and a wall surrounding the second substantially planar surface on all but one open side; the first and second sections being hinged together at points on each section adjacent to the open sides, the first and second sections being operable from a first position in which the walls of the first and second sections lie adjacent to each other to define an interior cavity and second position in which the first substantially planar surface is coplanar with and contiguous to the second substantially planar surface; and a base detachably securable to the first and second sections when the first and second sections are in the first position.

BRIEF DESCRIPTION OF THE DRAWINGS

In drawings which illustrate embodiments of the invention, by way of example.

DESCRIPTION OF THE PREFERRED EMBODIMENTS

Figure 1:
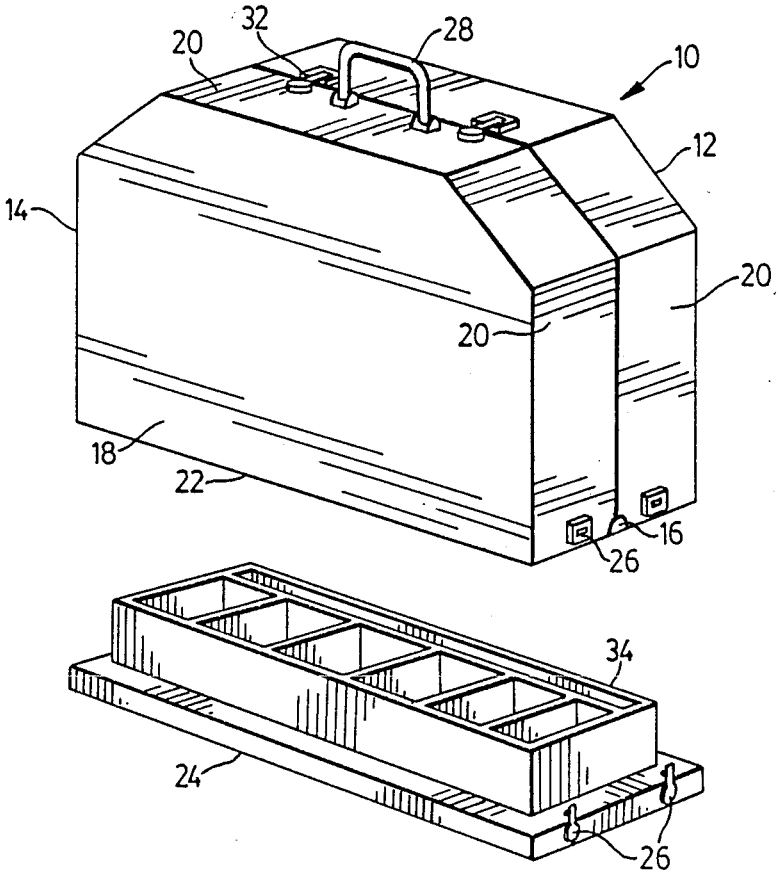
FIG. 1 is a perspective of a carrying container according to the invention in its closed position, with base detached.

Referring to each of the figures, the carrying container shown generally at 10 consists of two complimentary sections 12 and 14 hinged together by hinges 16. Each of the sections 12 and 14 has a substantially planar surface 18 and a wall 20 surrounding the substantially planar surface 18 on all but one open side 22. The hinges 16 are at each end of the open sides 22, and allow rotation of the sections 12 and 14 relative to each other from the closed position shown in FIG. 1, where the walls of each of the sections 12 and 14 lie adjacent each other to define an interior cavity, through the semi-open position shown in FIG. 2 to the fully open position shown in FIG. 3.

Figure 3:
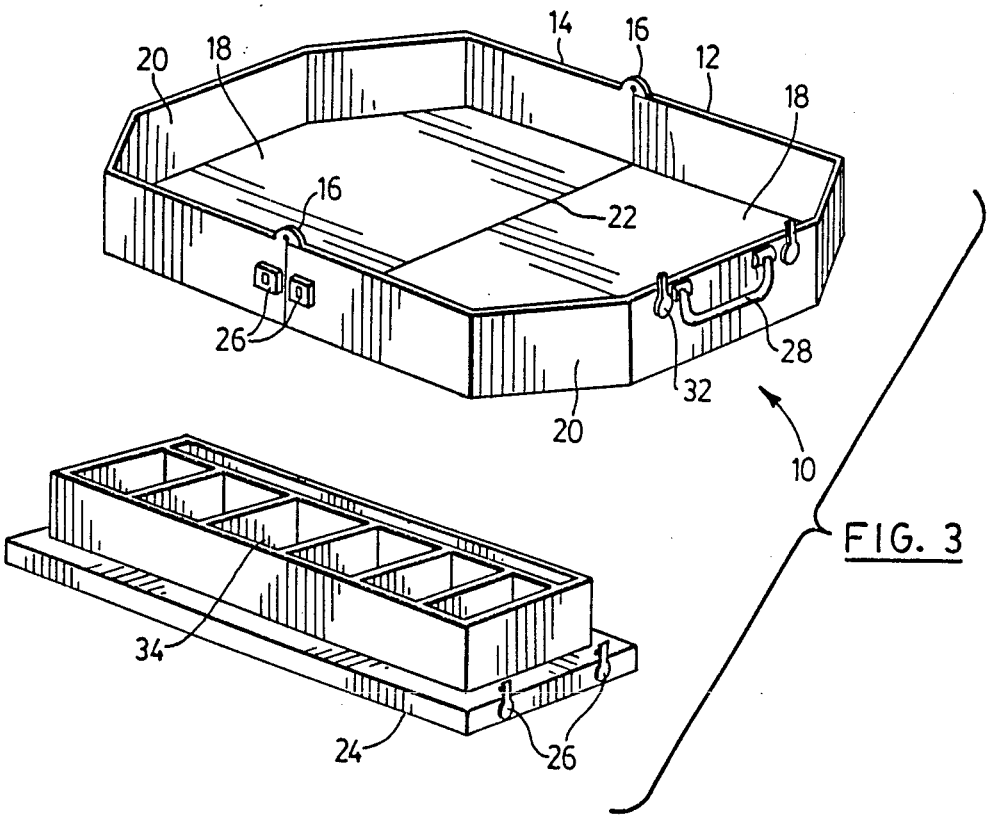
FIG. 3 is a perspective of a carrying container according to the invention in a fully open position with base detached.

In the fully open position, shown in FIG. 3, the two substantially planar surfaces 18 become substantially coplanar and contiguous to form a flat area for, for example, playing a board game or displaying articles. If used as a board game, with dice, the walls 20 serve to retain the dice on the game surface when they are thrown.

In the closed position, shown in FIG. 1, base 24 may be attached to the sides 22 of sections 12 and 14 by clasps 26. The base 24 and the interior cavity defined by the sections 12 and 14 enable the carrying container 10 to be used as a carrying container. As many clasps 26 should be used as are reasonably necessary to secure the base to the sections 12 and 14 to be reasonably secure for their intended function. If the base 24 is used to contain board game playing pieces and cards, then only two clasps 26 may be required. More clasps 26 may be required for carrying a greater weight. In the open position, shown in FIG. 3, the base 24 may be used as a holder, for example, of playing cards used with a board game, with card holders or compartments 34 for holding the playing cards. The substantially planar surfaces 18 may also be used for displaying jewellery or tools, and the carrying container 10 would then also have the dual function of a portable storage device.

The carrying container 10 may be carried by means of a handle 28 secured to one of the sections, here section 12, away from the base 24. Other positions of the handle 28 may be used. For example, for some applications, attachment of the handle 28 to the base 24 may be desirable.

Figure 2:
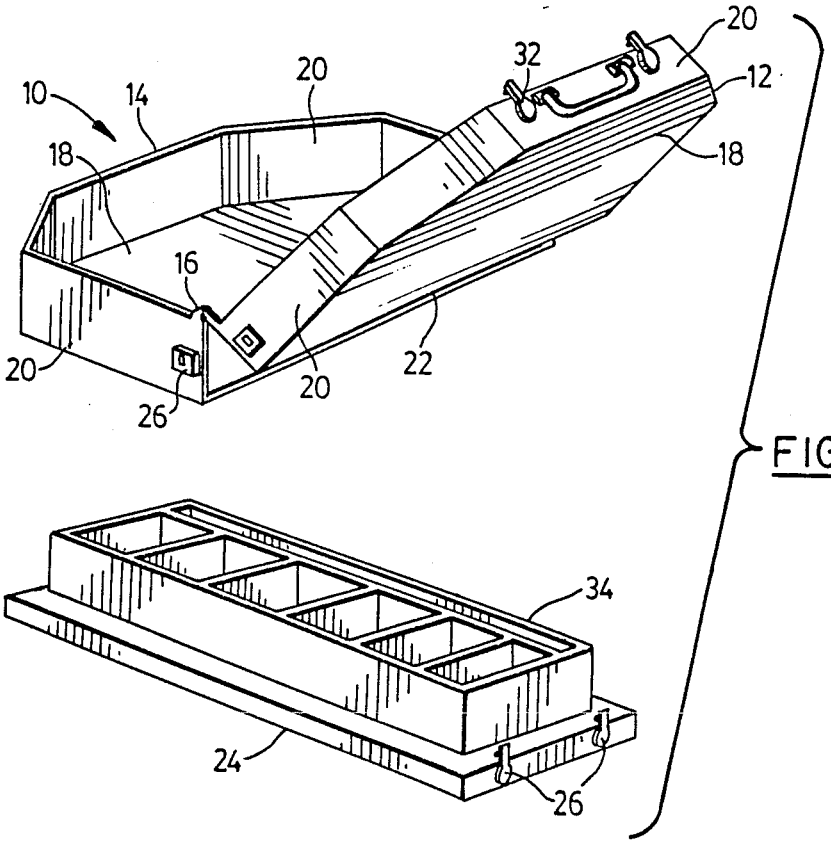
FIG. 2 is a perspective of a carrying container according to the invention in a semi-open position, with base detached.

The carrying container 10 may be maintained in the closed position by means of clasp 32. By releasing the clasp 32, the carrying container 10 may be opened as shown in FIG. 2, after detachment of the base 24.

The carrying container may be made of any suitable material such as wood or plastic. Various types of fastening devices may be used instead of the clasps 26 or 32, such as friction locks. If the carrying container 10 is made of plastic, the hinges may be simply webs of plastic between the two sections 12 and 14.

Various shapes of the substantially planar surfaces 18 may be used, such as triangular, semi-circular, rectangular or, as in the Figures, where the substantially planer surfaces 18 have a substantially rectangular shape with truncated corners. The walls 20 are shown perpendicular to the substantially planar surfaces 18 but may have other orientations, depending on their function. Vertical walls are particularly desirable in the case of a board game in which dice are thrown on the playing surface, since the vertical walls prevent the dice from leaving the playing surface.

Other modifications of the features illustrated here may occur to a person skilled in the art, without departing from what is defined by the following claims.

I claim:

1. A carrying container comprising:

a first section having a first substantially planar surface and a wall surrounding the first substantially planar surface on all but one open side;

a second section having a second substantially planar surface and a wall surrounding the second substantially planar surface on all but one open side;

the first and second sections being hinged together at points on the walls on each section adjacent the open sides;

the first and second sections being operable from a first position in which the walls of the first and second sections lie adjacent each other to define an interior cavity to a second position in which the first substantially planar surface is coplanar with and contiguous to the second substantially planar surface; and a base detachably securable to the first and second sections when the first and second sections are in the first position.

2. The carrying container of claim 1 in which the walls of each of the first and second sections are substantially perpendicular to the first and second substantially planar surfaces.

3. The carrying container of claim 1 in which the base includes compartments for playing cards.

* * * * *